US009803366B2

(12) United States Patent
Mosch

(10) Patent No.: US 9,803,366 B2
(45) Date of Patent: Oct. 31, 2017

(54) MASONRY REINFORCEMENT, DISPENSER FOR STRIPE-TYPE MASONRY REINFORCEMENT, METHOD TO REINFORCE A MASONRY AND METHOD TO PRODUCE A REINFORCEMENT STRIPE

(71) Applicant: Murinox Bautechnik AG, Neerach (CH)

(72) Inventor: Thomas Mosch, Riedt b. Neerach (CH)

( * ) Notice: Subject to any disclaimer, the term of this patent is extended or adjusted under 35 U.S.C. 154(b) by 0 days.

(21) Appl. No.: 14/790,042

(22) Filed: Jul. 2, 2015

(65) Prior Publication Data

US 2016/0002928 A1 Jan. 7, 2016

(30) Foreign Application Priority Data

Jul. 3, 2014 (DE) ..... 20 2014 005 401

(51) Int. Cl.

| | |
|---|---|
| ***E04B 2/00*** | (2006.01) |
| ***E04C 5/03*** | (2006.01) |
| ***B65H 16/00*** | (2006.01) |
| ***E04B 1/04*** | (2006.01) |
| ***E04B 2/02*** | (2006.01) |
| ***E04B 2/10*** | (2006.01) |

(52) U.S. Cl.

CPC ..... *E04C 5/03* (2013.01); *B65H 16/005* (2013.01); *E04B 1/04* (2013.01); *E04B 2/02* (2013.01); *E04B 2/10* (2013.01)

(58) Field of Classification Search

CPC ... E04C 5/03; E04C 5/168; E04C 5/18; E04B 2/20; E04B 2002/0282; E04B 2/10; E04B 2/30; E04B 1/4185; E04G 21/1841

USPC ..... 52/396.08, 396.09, 565, 568

See application file for complete search history.

(56) References Cited

U.S. PATENT DOCUMENTS

| | | | | |
|---|---|---|---|---|
| 641,067 | A * | 1/1900 | Blazo | E04B 2/10 52/438 |
| 828,550 | A * | 8/1906 | Inman | E04C 5/03 52/850 |
| 1,107,779 | A * | 8/1914 | Geraerdts | E04B 2/10 52/477 |
| 1,852,042 | A * | 4/1932 | Dean | E04C 5/03 52/241 |
| 2,100,958 | A * | 11/1937 | Erich | E04B 2/10 52/396.08 |
| 2,229,869 | A * | 1/1941 | Koch | E04B 2/10 52/581 |
| 2,669,116 | A * | 2/1954 | Erickson | E04C 1/42 52/604 |
| 3,374,589 | A * | 3/1968 | Neal, Jr. | E04G 21/1841 52/105 |

(Continued)

*Primary Examiner* — Gisele Ford

(74) *Attorney, Agent, or Firm* — Fay Sharpe LLP

(57) ABSTRACT

The invention is related to a masonry reinforcement and to a dispenser therefore. The masonry reinforcement comprises a reinforcement strip that defines a strip plane and that is at least in one direction bendable. In the reinforcement strip multiple strip apertures are arranged along the longitudinal direction of the strip, each strip aperture comprising an aperture rim at the aperture rim or in the range of the aperture rim of some or all of the strip apertures rim serration members are arranged. The rim serration members are orientated inwardly. They can protrude out of the strip plane of the reinforcement strip in at least one direction.

39 Claims, 6 Drawing Sheets

(56) References Cited

U.S. PATENT DOCUMENTS

| | | | | | |
|---|---|---|---|---|---|
| 4,305,239 | A * | 12/1981 | Geraghty | E04B 1/41 | 52/379 |
| 4,689,931 | A * | 9/1987 | Hodges | E04B 1/4178 | 52/442 |
| 5,193,320 | A * | 3/1993 | Coccagna | E04G 21/1841 | 52/308 |
| 5,548,940 | A * | 8/1996 | Baldock | B65B 63/04 | 242/175 |
| 7,017,318 | B1 * | 3/2006 | Hohmann | E04B 2/30 | 52/379 |
| 2003/0029123 | A1 * | 2/2003 | Pignataro | E04B 2/02 | 52/712 |
| 2009/0022980 | A1 * | 1/2009 | Sugimoto | B05D 1/02 | 428/327 |
| 2013/0167469 | A1 * | 7/2013 | Coccagna | E04C 5/168 | 52/677 |

* cited by examiner

MASONRY REINFORCEMENT, DISPENSER FOR STRIPE-TYPE MASONRY REINFORCEMENT, METHOD TO REINFORCE A MASONRY AND METHOD TO PRODUCE A REINFORCEMENT STRIPE

FIELD OF THE INVENTION

The invention is related to a masonry reinforcement. The masonry reinforcement comprises a reinforcement strip. For example, in a masonry joint, a reinforcement strip can be arranged. By this reinforcement strip a strip plane will be defined. The reinforcement strip is bendable at least in one direction, for example in that plane, that is perpendicular or almost perpendicular to the strip plane. Multiple strip apertures, each with an aperture rim, can be arranged along the longitudinal strip direction. A clawing is achieved between the mortar or the masonry and the reinforcement strip, wherein the clawing is strengthened by the strip apertures being penetrated with the mortar. Additionally in the masonry joint the mortar surrounds the reinforcement strip. The strip apertures can be arranged on the reinforcement strip in a regular or periodic manner. Thus the strip apertures can be arranged adjacent or side by side to each other, particularly comprising a strip aperture distance.

The is Invention is also related to a dispenser for strip type masonry reinforcement. Preferably, the dispenser is appropriate for a masonry reinforcement described herein. The dispenser comprises a rack or a dispenser housing, in which at least one dispenser roll is arranged on a dispenser axis. On the dispenser roll the masonry reinforcement is arranged in a coiled manner. The masonry reinforcement can be fit through a dispenser opening, that is arranged within the rack or the dispenser housing. The masonry reinforcement can be dispensed by rolling the dispenser roll.

The invention is also related to a method to reinforce a masonry. According to this, the masonry comprises multiple rows of masonry bricks, the rows being arranged on top of each other or adjacent to each other. In a joint, particularly in a horizontal joint or in a bed joint, at least one stripe-type reinforcement member is arranged at least in sections.

The invention is also related to a method to produce a reinforcement strip for a masonry reinforcement. According to this, the method comprises arranging strip apertures in a reinforcement strip, particularly in periodic or regular arrangement.

TECHNICAL BACKGROUND

When building a masonry bricks are connected with plaster or mortar. In order to strengthen the connection of the bricks and thus to reinforce the masonry, temporarily and/or where necessary reinforcement elements are arranged between the masonry bricks, the reinforcement elements generating a clawing with the mortar and/or the bricks. If a wall with defined wall thickness is established with the masonry, between the rows of the masonry bricks usually reinforcement stripes are used as reinforcement elements. The reinforcement stripes are bendable in at least one direction. This is why the reinforcement stripes are offered in coiled condition. For use in the masonry the reinforcement stripes are rolled off a roll and cut to the required length. Thereby a consideration of the wall thickness is almost insufficient.

DESCRIPTION OF THE INVENTION

The invention is based on the problem, whereupon arrangements should be described with respect to improved and simplified and simultaneously flexible useable masonry reinforcement. This problem is solved by a masonry reinforcement comprising a reinforcement strip, wherein the reinforcement strip defines a strip plane and being bendable in at least one direction, and wherein the reinforcement strip along the longitudinal strip direction being provided with multiple strip apertures, each of said strip aperture comprising an aperture rim, characterized in that rim serration members are arranged at the aperture rims or in the region of the aperture rims of some or of all of the strip apertures. According to this, rim serration members are arranged at aperture rims or in the region of aperture rims of some or of all of the strip apertures. According to a preferred embodiment the rim serration members in at least one direction protrude out of the strip plane of the reinforcement stripe. The orientation of the rim serration members can—with respect to the strip apertures—be inwardly, that means that within the strip plane the rim serration members protrude into the region of the strip aperture. With this arrangement spalling and chipping in the outer section of the reinforcement, that is to say at the edge of the strip, can be avoided, the spalling and chipping caused by the clawing or the serration and by forces acting in a mostly horizontal direction. Thus masonry reinforcement will be improved.

According to an embodiment of the invention the orientation of the rim serration members can be perpendicular or almost perpendicular to the stripe plane. With the aperture rim serration an improved clawing between the reinforcement stripe and its surrounding (masonry and/or mortar) will be achieved. The rim serration members preferably extend within a direction that differs from that direction that is defined by the stripe plane. With respect to a horizontally orientated layer or position of the reinforcement stripe, the rim serration members can thus have an extension that is upward and/or downward orientated.

The rim serration members can be generated by bending or die-cutting of the aperture rims and/or of aperture rim portions of the stripe apertures, wherein the stripe aperture comprise the rim serration members. For example the aperture rims of the stripe apertures can comprise an uneven course, particularly a serrated or almost serrated or a wavy or almost wavy course. "Almost" in this context means, that rounding's or bevels or arbitrary, that means free, form components can be provided. Thus the course of the rim of the aperture for example can have a saw teeth shape, that means at least sections of the rim of the aperture comprise angled spikes. The spikes are bent out of the stripe plane and are rim serration members, where the clawing of the reinforcement stripe with its surrounding is enhanced with this rim serration members. Bending out the spikes can be performed upward or downward—with respect to the horizontal position of the reinforcement stripe. Provisions can be made for some of the spikes being bent upwards and some of the being bent downwards. The bending angle can be about ±90° with respect to stripe plane, angles in an angle range between about ±5° and about ±175° can be provided (with respect to stripe plane, defining the 0°-angle). In the alternative to or in the addition to spike-formed folded elements, in a section, round or oval folded elements can be provided. This can be achieved when the aperture rim at least along a section or along the whole circumference comprises a wave form. Adjacent wave peaks of the wave form generate rim serration members or folding members.

The stripe apertures of the reinforcement stripe can be round or almost round, oval or almost oval, triangular or almost triangular, rectangular or almost rectangular, or polygonal or almost polygonal. "Almost" in this context means, that at least along a section from the geometry of a circle/oval/triangle/rectangle can be derived from. For instant within a rectangular stripe aperture, roundings in the range of the corners of the rectangular can be provided. At least of some of the stripe apertures the rims can be made arbitrary that means according to a free form.

Arrangements for a simplified and simultaneously flexible to handle masonry enforcement are provided with a masonry enforcement comprising a reinforcement strip, wherein the reinforcement strip defines a strip plane and being bendable in at least one direction, and the reinforcement strip along the longitudinal stripe direction being provided with multiple strip apertures, each of the strip aperture comprising an aperture rim, characterized in that surface serration members are arranged on the reinforcement strip, preferably adjacent to and/or between the strip apertures. According to this surface serration members are arranged on the reinforcement strip, particularly adjacent to and/or between the strip apertures. The surface serration members enhance the clawing of the reinforcement strip with its surrounding, for example with the mortar that surrounds the reinforcement stripe. The surface serration members are arranged on the surface of the reinforcement strip and they generate a profile on the surface of the reinforcement strip in the range of the strip apertures. Thus the effective area of the surface of the reinforcement strip is increased, so that a better contact and conjunction with the materials surrounding the reinforcement strip will be achieved (masonry brick, mortar, etc.). Some or all of the surface serration members can be generated by roughening the surface of the strip in sections or by a stamping arranged within the surface of the strip. The roughening can be achieved by a mechanical treatment of surface, for example by filing, by brushing, by milling or by polishing tools.

Provisions can be made such that at least some of the surface serration members are generated by cams, wherein the cams are arranged on the surface of the stripe. The cams protrude out of the surface of the reinforcement stripe. The cams generate effecting region with respect to the connecting or clawing effect of the reinforcement stripe. "Some" in this connection means, that for example between two adjacent stripe apertures, on a stripe land, or deside an arbitrary number of stripe apertures on the stripe edge region one or more cams can be arranged. The result is, that on the reinforcement stripe multiple (some) cams are arranged.

Preferably the surface serration members are made by a labeling and/or lettering. The surface of the stripe comprises a modification of surface structure, wherein the modification is arranged by labeling and/or the lettering or in the range of the labeling and/or lettering. The labeling can be made by embossment, stamping or punching shear. Thus the surface of the reinforcement stripe is not plain. The embossment can be made such, that elements from the labeling protrude out of the surface. Thereby a further clawing of the reinforcement stripe with its surrounding will be achieved.

The reinforcement stripe can be made of a metal or metal alloy or of a noble metal or noble metal alloy. The reinforcement stripe can be zinc coated or galvanized or otherwise coated. Alternatively the reinforcement stripe can be made of nonmetallic material.

Arrangements for a simplified and simultaneously flexible to handle masonry reinforcement are provided with a dispenser for stripe-type masonry reinforcement. The dispenser can be suitable for a masonry reinforcement described herein. The dispenser comprises a dispenser rack or dispenser housing. In the rack or in the housing a dispenser roll is arranged on a dispenser axis. On the dispenser roll the stripe type masonry reinforcement is arranged, the stripe-type masonry reinforcement is coiled on the dispenser roll. The masonry reinforcement is dispensable by unrolling the dispenser roll. If a housing is provided, it can be arranged, that the masonry reinforcement is dispensed from the housing by feeding it trough a dispenser opening.

Arrangements for a simplified and simultaneously flexible to handle masonry reinforcement are further provided by a dispenser for a stripe-type masonry reinforcement. Preferably the dispenser is appropriate for dispensing a strip-type masonry reinforcement described herein. The dispenser comprises a dispenser housing or a rack, in which at least the rotatable dispenser roll is arranged on a dispenser axis. On the dispenser roll the strip-type masonry reinforcement is coiled in a manner, which is principal known. If a housing is provided, the masonry reinforcement can be dispensed from the dispenser housing by feeding trough a dispenser opening. The reinforcement is dispensable by unrolling the strip from the dispenser roll. The strip-type masonry reinforcement is arranged on a first dispenser roll portion and on a second dispenser roll portion, wherein the second dispenser roll portion is spaced apart from the first dispenser roll portion. Thus from the dispenser two masonry reinforcement strips are dispensable, wherein both masonry reinforcement strips are dispensable from the dispenser simultaneously. Preferably the reinforcement strips can be arranged parallel or almost parallel to each other, which is advantageous in combination with the masonry comprising a corresponding masonry thickness (or masonry size). In addition to a simplified handling the dispenser allows a simple storing of masonry reinforcements for different masonry thickness, masonry size or wall distances.

With respect to using the dispenser or the masonry reinforcements described herein for different or variable wall size it can be achieved that the distance between the first dispenser roll portion and the second dispenser roll portion within the dispenser housing or the rack is variable. The variation or modification of the distance can be achieved by an appropriate, particularly manufacturer related, choice of the dispenser roll geometry with appropriate positioned roll portions. Further arrangements for a simplified and simultaneously flexible to handle masonry reinforcement are provided with a dispenser. According to this at least one further dispenser roll is provided, wherein the further dispenser roll is arranged on the dispenser axis and spaced apart from the first dispenser roll. From the dispenser at least two masonry reinforcement stripes are, preferably simultaneously, dispensable, wherein the first strip is dispensable from the first roll, and the second strip from the second roll. Dispensing of the reinforcement strips is made such, that the reinforcement strips are arranged parallel or almost parallel to each other.

With respect to an individually adjustable reinforcement stripe distance, it can be preferred, that the distance between the first dispenser roll and the at least one further dispenser roll within the dispenser housing or on the rack is variable. A distance between dispenser rolls can be chosen on manufactures side and preset with fixed values, for example for a certain masonry thickness or masonry size. Alternatively the distance can be varied by the user of the dispenser. Variation of dispenser roll distance can be achieved with the (linear) operating element, which is arranged within the rack or dispenser housing, and which is accessable for the user. Sliding of dispenser roll on dispenser axis up to a desired distance can be achieved, wherein a dispenser housing should comprise an appropriate operation opening therefore.

The dispenser can be constructed such, that the masonry reinforcement on the first dispenser roll portion, or on the first dispenser roll, can be unrolled independently from the masonry reinforcement on the second spender roll portion, or on the further roll. Thus the stripes of the reinforcement can be unrolled separately.

Connecting elements can be provided such, that the reinforcement stripe of the masonry reinforcement on the first dispenser roll portion, or on the first dispenser roll, is at least within a section connected with the reinforcement stripe of the second dispenser roll portion, and/or on the further dispenser roll. With this connecting elements the masonry reinforcement stripes of the first roll (of the first roll portion) and the stripe of the further roll (of the second roll portion) are fixed together, so that simultaneously and collective unrolling of the stripes is possible. Furthermore a clawing of the reinforcement stripes among themselves will be achieved, wherein the reinforcement stripes are to be arranged within the masonry, and wherein the reinforcement stripes are arranged next to each other. Stability of the masonry thus will be improved.

It can be provided that the serration elements of the masonry reinforcement coiled within the dispenser are orientated inwardly—with reference to the stripe apertures of the stripes. According to a preferred embodiment of the dispenser the stripe type masonry reinforcement comprises serration member protruding out of the stripe plane of the reinforcement stripe or of the adjacent reinforcement stripes. The serration members of the masonry reinforcement coiled within the spender can be orientated into the direction of dispenser axis.

Arrangements for a simplified and simultaneously flexible to handle masonry reinforcement are provided with a dispenser. According to this fixing means and or guidance means are provided, wherein the fixing means and/or guidance means are arranged at the rack or at the housing. With this fixing means the rack or housing can be fixed on the masonry. With the guidance means the rack or the housing can be guided along the edge of the masonry, particularly along the portion of the masonry, where the masonry reinforcement will have to be arranged. The fixing or guidance means can be established as clamp device or as a pair of prongs. The fixing and/or guidance means interacts within the masonry, particularly with the top portion of the masonry, such, that the dispenser can be fixed on the masonry and/or the dispenser can be guided on the masonry. The fixing and/or guiding means can be made as a one part or multipart device. The fixing and/or guiding means can comprise an adjustment means, where the fixing and or guiding means is fitable with the geometric dimensions of the masonry or masonry portions by the adjustment means. By fixing the dispenser of the masonry dispending the reinforcement is facilitated in so far, as the dispenser fixed to the masonry provides enough resistance, so that the reinforcement strips can be dispensed from the dispenser without the necessity of retaining the dispenser by the user. Within the range of the masonry enough reinforcement strips have been dispensed, the dispenser can be guided to a new fixing position along the masonry by the help of the guiding means. At the new fixing position further reinforcement strips can be dispensed. The guiding means can comprise movable particularly pirotable components.

Arrangements for a simplified and simultaneously flexible to handle masonry reinforcement are provided by a method to reinforce masonry. The masonry comprises multiple rows of masonry bricks the rows being arranged adjacent and/or on top of each other. In at least a joint, preferably in a horizontal joint or in a bed joint, at least one strip-type reinforcement member is arranged at least in sections. Particularly the reinforcement member is made of a strip-type masonry reinforcement described herein. Preferably the reinforcement members are dispensed from a dispenser described herein. The distance of the reinforcement members will be fitted to the masonry with, for example with the dispenser.

Arrangements for a simplified and simultaneously flexible to handle masonry reinforcement are provided by a method to produce a reinforcement strip for masonry reinforcement. The aperture rim of the strip apertures comprises bendable rim serration members. The rim serration members are bent out of the plane defined by the reinforcement strip.

Arrangements for a simplified and simultaneously flexible to handle masonry reinforcement are further provided by the method to produce a reinforcement stripe, the method comprising arranging surface serration members in the range of the stripe apertures, so that the surface of the reinforcement stripe comprises a profile. Arrangement of the surface serration members can be achieved by embossing, by roughening, by filing, by brushing, by milling, by stamping and/or by labeling or lettering.

The above mentioned components to be used according to the invention, as well as those claimed and described in the examples of the embodiments, are not subject in size, shaping, material selection and technical conception to any special exceptional conditions, so that the selection criteria known in the field of application can be applied without restriction.

Additional details, characteristics and advantages of the invention result from the subclaims as well as from the description below of the associated join in which, for sake of example, an embodiment of the masonry reinforcement as well of a dispenser for a reinforcement are illustrated. Single features of the claims of the embodiments can be combined with other features of other claims and embodiments.

In summary, the invention is directed to a masonry reinforcement comprising a reinforcement strip. The reinforcement strip defines a strip plane and being bendable in at least one direction. The reinforcement strip along the longitudinal strip direction being provided with multiple strip apertures. Each of the strip aperture comprising an aperture rim. The rim serration members are arranged at the aperture rims or in the region of the aperture rims of some or of all of the strip apertures. The rim serration members in at least one direction optionally protrude out of the strip plane of the reinforcement strip. The rim serration members optionally are oriented inwardly with respect to each of the strip aperture. The rim serration members are optionally generated by bending or die-cutting of the aperture rims and/or of aperture rim portions of the strip apertures. The strip apertures optionally comprise the rim serration members. The aperture rims of the strip apertures with the rim serration members optionally comprise an uneven course, preferably a serrated or almost serrated or a wavy or almost wavy course. The strip apertures are optionally generated round or almost round, oval or almost oval, triangular or almost triangular, rectangular or almost rectangular, or polygonal or almost polygonal. The surface serration members are optionally arranged on the reinforcement strip, preferably adjacent to and/or between said strip apertures. Some or all of the surface serration members are optionally generated by roughening the surface of the strip in sections or by stampings arranged in the strip surface. At least some of the surface serration members are optionally generated by cams, and the cams are arranged on the surface of the strip. At least some of the surface serration members are optionally generated by a labeling and/or lettering, and wherein the strip surface comprises a modification of surface structure, and the modification is arranged by the labeling and/or lettering or in the range of the labeling and/or lettering. The reinforcement strip is optionally made of a metal or a metal alloy or of a noble metal or a noble metal alloy. The reinforcement strip is optionally made of a nonmetallic material. The invention is also directed to a masonry reinforcement comprising a reinforcement strip, wherein the reinforcement strip defines a strip plane and being bendable in at least one direction, and wherein the reinforcement strip along the longitudinal strip direction being provided with multiple strip apertures, and wherein each of the strip aperture comprises an aperture rim, and wherein the surface serration members are arranged on the reinforcement strip, preferably adjacent to and/or between the strip apertures. Some or all of the surface serration members are optionally generated by roughening the surface of the strip in sections or by stampings arranged in the surface of the strip. At least some of the surface serration members are optionally generated by cams, and the cams being arranged on the strip surface. At least some of the surface serration members are optionally generated by a labeling and/or lettering, and wherein the surface of the strip comprises a modification of surface structure, and wherein the modification is arranged by the labeling and/or lettering or in the range of the labeling and/or lettering. The reinforcement strip is optionally made of a metal or a metal alloy or of a noble metal or a noble metal alloy. The reinforcement strip is optionally made of a nonmetallic material. The invention is also directed to a dispenser for strip-type masonry reinforcement, preferably for a masonry reinforcement, wherein the dispenser comprising a dispenser rack or dispenser housing, and wherein a dispenser roll is arranged on a dispenser axis, and wherein the stripe-type masonry reinforcement is coiled on the dispenser roll, and the masonry reinforcement is dispensable by unrolling the dispenser roll, and preferably dispensable out of the dispenser housing through a dispenser opening. The serration members of the masonry reinforcement coiled in said dispenser are optionally orientated inwardly. The strip-type masonry reinforcement optionally comprises serration members protruding out of the strip plane of the reinforcement strip, and wherein the serration members of the masonry reinforcement coiled within the dispenser are orientated in a direction towards the dispenser axis. The fixing means and/or guidance means are optionally arranged at the rack or the housing, and wherein the rack or the housing is fixable on a masonry or being guidable along a masonry. The invention is also directed to a dispenser for strip-type masonry reinforcement, preferably for a masonry reinforcement, wherein the dispenser comprises a dispenser rack or dispenser housing, and wherein at least a dispenser roll is arranged on a dispenser axis, and wherein the strip-type masonry reinforcement is coiled on the dispenser roll, and wherein the masonry reinforcement is dispensable by unrolling the dispenser roll, preferably dispensable out of the dispenser housing through a dispenser opening, and wherein the strip-type masonry reinforcement is arranged on a first dispenser roll portion and on a second dispenser roll portion, and wherein the second dispenser roll portion is arranged by spacing apart from the first dispenser roll portion, and whereby two masonry reinforcement strips are dispensable from the dispenser. The distance between the first dispenser roll portion and the second dispenser roll portion is optionally variable within the dispenser rack or the dispenser housing. At least one further dispenser roll is optionally provided, and wherein the further dispenser roll being arranged on the dispenser axis and spaced apart from the first dispenser roll, and the masonry reinforcement strip is coiled on the further dispenser roll, and whereby at least two masonry reinforcement strips are dispensable from the dispenser. The distance between the first dispenser roll and the at least one further dispenser roll in the dispenser rack or in the dispenser housing is optionally variable. There is optionally provided connecting elements, and wherein the reinforcement strip of the masonry reinforcement on the first dispenser roll portion or on the first dispenser roll is at least in sections connected with the reinforcement strip on the second dispenser roll portion and/or on the further dispenser roll. The masonry reinforcement on the first dispenser roll portion or on the first dispenser roll is optionally dispensable independently from the masonry reinforcement on the second dispenser roll portion or on the further dispenser roll. The serration members of the masonry reinforcement coiled in the dispenser are optionally orientated inwardly. The invention is also directed to a masonry reinforcement wherein serration members protruding out of the strip plane of the reinforcement strip, and wherein the serration members of the masonry reinforcement that are coiled within the dispenser are orientated in the direction towards the dispenser axis. A fixing means and/or guidance means are optionally arranged at the rack or the housing, and wherein the rack or the housing are fixable on a masonry or being guidable along a masonry. The invention is also directed to a dispenser for strip-type masonry reinforcement wherein the dispenser comprises a dispenser rack or dispenser housing, and wherein at least a dispenser roll is arranged on a dispenser axis, and wherein there is provided at least one further dispenser roll, and wherein the further dispenser roll is arranged on the dispenser axis spaced apart from the first dispenser roll, and wherein the masonry reinforcement strip is coiled on the further dispenser roll, and whereby at least two masonry reinforcement strips are dispensable from the dispenser. The distance between the first dispenser roll and the at least one further dispenser roll in the dispenser rack or in the dispenser housing is optionally variable. Optionally providing connecting elements, and wherein the reinforcement strip of the masonry reinforcement on the first dispenser roll portion or on the first dispenser roll is at least in sections connected with the reinforcement strip on the second dispenser roll portion and/or on the further dispenser roll. The masonry reinforcement on the first dispenser roll portion or on the first dispenser roll is optionally dispensable independently from the masonry reinforcement on the second dispenser roll portion or the further dispenser roll. Serration members of the masonry reinforcement are optionally coiled in the dispenser are orientated inwardly. The strip-type masonry reinforcement optionally comprises serration members protruding out of the strip plane of the reinforcement strip, characterized in that the serration members of the masonry reinforcement coiled within the dispenser are orientated in the direction towards the dispenser axis. Fixing means and/or guidance means are optionally arranged at the rack or the housing, and wherein the rack or the housing are fixable on a masonry or are guidable along a masonry. The invention is also directed to a dispenser for strip-type masonry reinforcement, preferably for a masonry reinforcement, wherein the dispenser comprises a dispenser rack or dispenser housing, and wherein at least a dispenser roll is arranged on a dispenser axis, and wherein the fixing means and/or guidance means are arranged at the rack or the housing, and wherein the rack or the housing are fixable on a masonry or are guidable along a masonry. The invention is also directed to a method to reinforce a masonry with multiple rows of masonry bricks, and wherein the rows are arranged adjacent and/or on top of each other, and wherein in a joint, preferably in a horizontal joint or in a bed joint, at least one strip-type reinforcement member is arranged at least in sections, and wherein the reinforcement member is made of a masonry reinforcement. The reinforcement member is dispended from a dispenser, and the distance between the reinforcement member is adapted to the width of the masonry and/or to the size of the masonry. The invention is also directed to a method to reinforce a masonry with multiple rows of masonry bricks, and the rows are arranged adjacent and/or on top of each other, and wherein in a joint, preferably in a horizontal joint or in a bed joint, at least one strip-type reinforcement member is arranged at least in sections, and wherein the reinforcement member is dispended from a dispenser, and the distance between the reinforcement members is adapted to the width of the masonry and/or to the size of the masonry. The invention is directed to a method to produce a reinforcement strip for a masonry reinforcement, preferably for a masonry reinforcement, comprising arranging strip apertures in a reinforcement strip preferably in periodic arrangement, and wherein an aperture rim of the strip apertures comprises bendable rim serration members, and wherein in that the method further comprises bending the rim serration members such that the rim serration members are bent out of the plane defined by the reinforcement strip. The surface serration members are optionally arranged in the proximity of the strip apertures, and wherein the surface serration members providing the surface of the reinforcement strip with a profile. The surface serration members are optionally arranged by embossing, by roughening, by filing, by brushing, by milling, stamping, and/or by labelling and/or lettering of the surface. The invention is also directed to a method to produce a reinforcement strip for a masonry reinforcement, preferably for a masonry reinforcement, and wherein the method comprises arranging strip apertures in a reinforcement strip, preferably in periodic arrangement, and wherein the surface serration members are arranged in the proximity of the strip apertures, and wherein the surface serration members are providing the surface of the reinforcement strip with a profile. The surface serration members are optionally arranged by embossing, by roughening, by filing, by brushing, by milling, stamping, and/or by labelling and/or lettering of the surface.

DETAILED DESCRIPTION

Figure 1A:
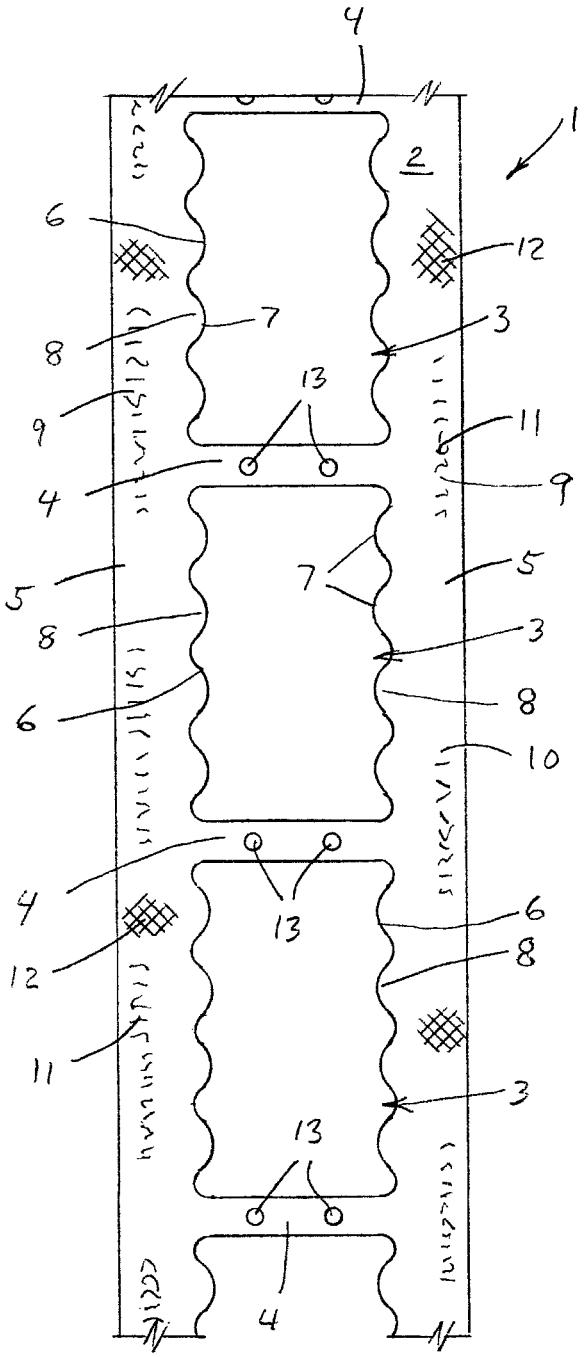
FIG. 1A is a top view on a section of a masonry reinforcement in schematic illustration.

A schematic top view of a section of a reinforcement stripe 1 of a masonry reinforcement can be found in FIG. 1A. According to the technical requirements, the reinforcement stripe 1 according to FIG. 1A will be incorporated within a masonry 26, there as a masonry reinforcement, wherein the stripe 1 is surrounded by masonry bricks and mortar arranged between the bricks.

The reinforcement stripe 1 according to FIG. 1A defines a stripe plane 2, that is according to FIG. 1A corresponding to the plane of projection. The reinforcement stripe 1 comprises multiple stripe apertures 3, where according to FIG. 1A three complete stripe apertures 3 can be seen. Further stripe apertures 3 are indicated within FIG. 1A by showing a section of the aperture. Between the stripe apertures 3 a stripe land 4 is arranged respectively. Lateral to the stripe apertures 3 the stripe edge 5 is arranged, that margins the stripe 1 laterally. The stripe apertures 3 are almost rectangular, wherein the corners of the almost rectangular stripe apertures 3 are rounded. The stripe apertures 3 make, that the reinforcement stripe 1 is not only surrounded by the mortar, but also penetrated by the mortar in the range of the apertures 3. Thus clawing of the reinforcement element with it surrounding is improved.

The stripe apertures 3 are arranged adjacent to each other along the longitudinal direction of the stripe 1. The stripe apertures 3 generate an material clearance within the reinforcement stripe 1, respectively. The stripe apertures 3 are margined by an aperture rim 6. The aperture rims 6 of the stripe apertures 3 shown in FIG. 1A have a wavelike characteristic—at least along sections. The wave peaks 7 (or at least at some of the wave peaks 7) of the aperture rims 6 generate rim serration members 8. The rim serration members 8 are bendable such, that they protrude out of the stripe plane 2. By bending the rim serration members 8 or of the stripe aperture rims 6, the reinforcement stripe 1 is appropriate for better clawing or toothing of the stripe with its surrounding (mortar, bricks).

In the alternative to the wavelike wavy or characteristic of the aperture rims 6, a serrated, particularly saw-toothed, characteristic can be provided, which is not shown in FIGS. 1A to 4. Within a saw-toothed characteristic of the aperture rims the teeth (or at least some of the teeth) generate rim serration members 8, that can be bent out of the plane of the reinforcement stripe 1.

Figure 1B:
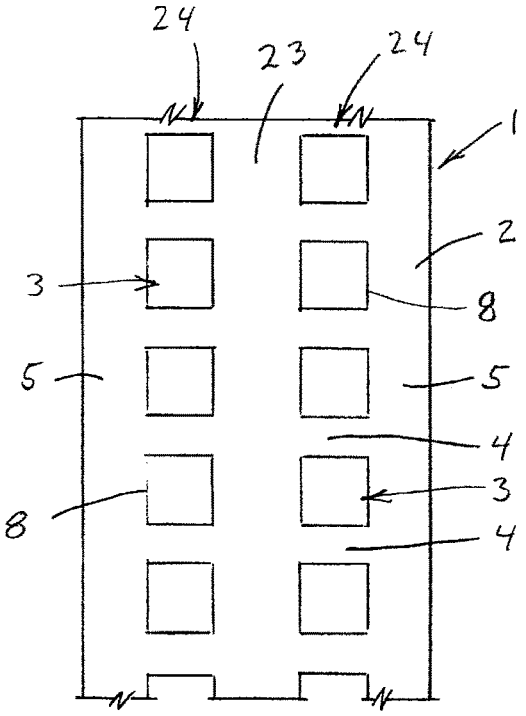
FIG. 1B is a top view on a section of a first version of a masonry reinforcement in schematic illustration.

According to FIG. 1A the rim serration members 8 at the stripe apertures 3 can be bent out in up or bottom direction with respect to the stripe plane 2 (as for example shown in the schematic illustration according to FIG. 1B). Bending out the rim serration members 8 can be achieved such, that stamping of the stripe apertures 3 is followed by a method step of bending. It can also be provided, that the method step of stamping comprises bending of the serration members 8.

According to FIG. 1A on the reinforcement stripe 1 surface serration elements 9 can be found. The surface serration members 9 are arranged on the surfaces 10 of the reinforcement stripe 1, that means on the stripe lands 4 and/or on the stripe edges 5. The surface serration members 9 according to FIG. 1A are thus arranged adjacent and/or between the stripe apertures 3. The surface serration numbers 9 are generated such, that within the surface 10 of the stripe a labelling or lettering 11 is stamped in. By stamping and by the material replacement accompanied with the stamping, in the range of the lettering 11 material from the reinforcement stripe 1 emerges out of the surface 10 of the reinforcement stripe 1 and generates surface serration members 9. The lettering 11 thus at least partly emerges out of the surfaces 10 of the stripe 1 or out of the stripe plane 2, and thus enables additionally clawing of the reinforcement stripe 1 with its surrounding. Furthermore the lettering 11, particularly because of the embossing or stamping, can comprise notches and/or recesses or cavities within the material of the reinforcement stripe 1, that additionally contribute to clawing, and that are integral part of the surface serration members 9.

It can be provide that sections 12 of the surface 10 of the reinforcement stripe 1 are roughened, so that a further optimization of clawing of the stripe 1 with its surrounding will achieved. Additionally (or in the alternative) cams 13 enhance the effect of clawing.

The reinforcement stripe 1 according to FIG. 1A can be made from a metallic material or made from such material, that comprises a metal or a metal alloy. The reinforcement stripe 1 according to FIG. 1A is bendable, particularly within a direction, that is not within the stripe plane 2. In particular, stripe 1 is coilable to a coil of stripe in a way that is in principal known.

Figure 1C:
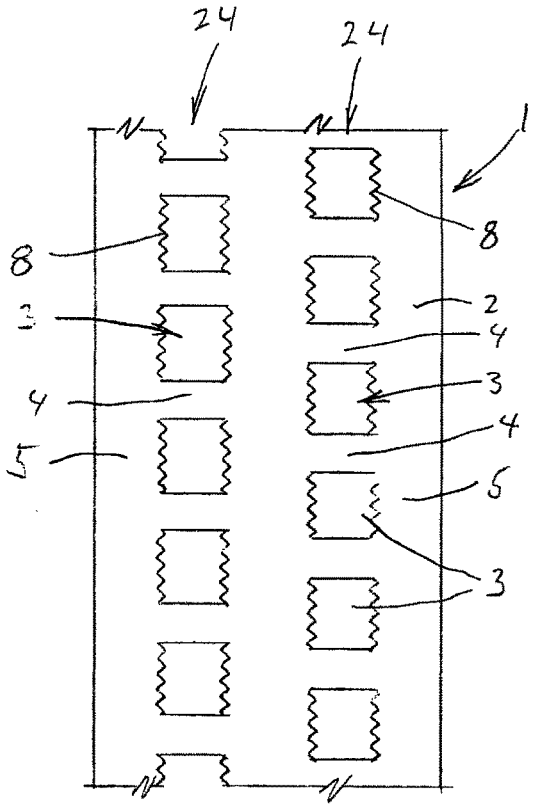
FIG. 1C is a top view on a section of a second version of a masonry reinforcement in schematic illustration.

Schematic illustrations of versions of a reinforcement stripe 1 according to FIG. 1A can it be found the FIGS. 1B and 1C. According to FIG. 1B it is provided, that the reinforcement stripe 1 comprises stripe apertures 3, the apertures 3 being arranged next to each other in two rows 24. More then two rows 24 can be allowed. According to FIG. 1B the stripe aperture 3 of the first row 24 are adjacent to the stripe apertures 3 of the second row 24 such, that in longitudinally direction of the stripe 1 mutual stripe lands 4 are generated between the stripe aperture 3, that means that the stripe lands 4 extend from the left stripe edge 5 to the right stripe edge 5 in continuous manner. Between the left and the right stripe edge 5 an intermediate stripe range 23 is arranged. The rows 24 with the stripe aperture 3 are positioned between the stripe edge 5 and the intermediate stripe range 23.

A section of a reinforcement stripe 1 with two rows 24 of stripe apertures 3 is schematically shown in FIG. 1C, therein the stripe apertures 3 of the adjacent rows 24 show a position offset. The offset can be regular, that means constant over the length of the stripe 2, alternatively the offset can be unregular or varying. According to a further version, that is not shown in the figures, the stripe apertures can be arranged in the stripe plane in an arbitrary and/or unregular manner.

According to the layout shown in the FIGS. 1B and 1C it will be achieved, that the length of the aperture rim per unit length of the reinforcement stripe will be enhanced, so that more rim serration members 8 per unit length of the reinforcement stripe can be arranged, so that clawing of the reinforcement element 1 with its surrounding is improved.

Figure 1D:
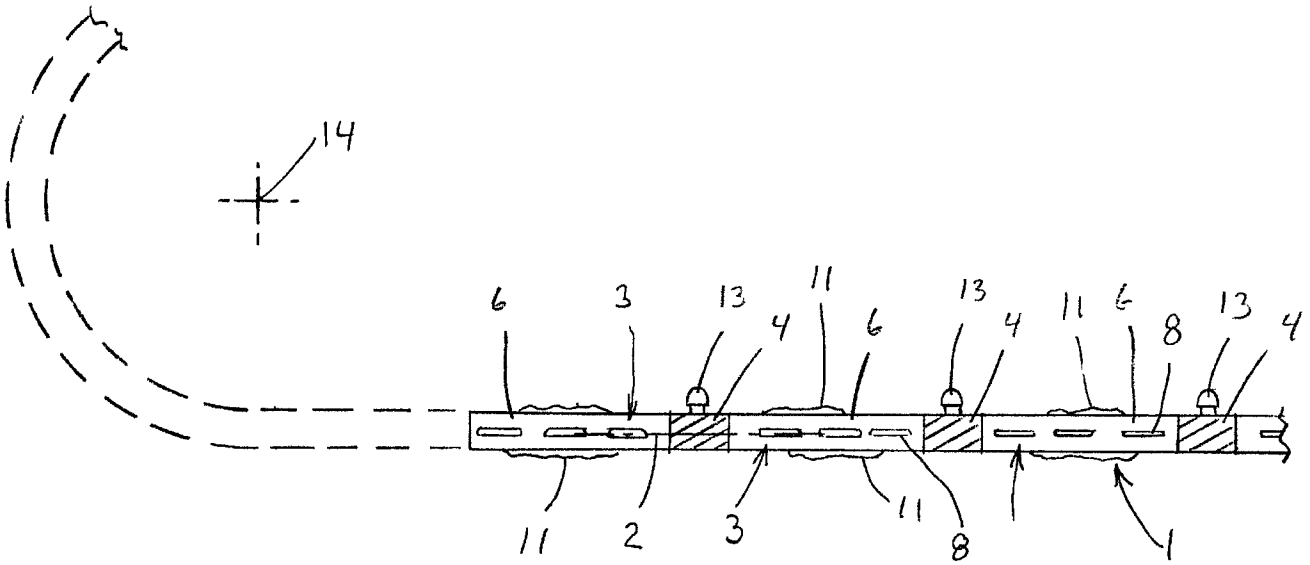
FIG. 1D is a schematic sectional view through the center of a reinforcement stripe with rim serration members and surface serration members.

A schematic side view of a masonry reinforcement 1 is shown in FIG. 1D. The reinforcement stripe 1 is from a dispenser roll, the dispenser roll being arranged on a dispenser axis 14, what is schematically indicated in FIG. 1D with dashed lines. In the reinforcement stripe 1 multiple stripe apertures are arranged adjacent to each other. The cutting plane of the sectional view according to FIG. 1D is centred or almost centred with respect to the stripe width and it is perpendicular to the stripe plane. As such FIG. 1D also shows the stripe lands 4 between the stripe apertures. At the aperture rims 6 of the stripe apertures 3 rim serration members are arranged, wherein the rim serration members are arranged such, that they protrude out of the plane of projection according to FIG. 1D. At the outer edges of the stripe edge regions (5) no serration members are provided.

Moreover FIG. 1D shows surface serration members protruding out of the stripe plane. The surface serration members 9 can be made as cams 13 or as labelling/lettering 11, the labelling/lettering being stamped within the stripe.

Figure 2:
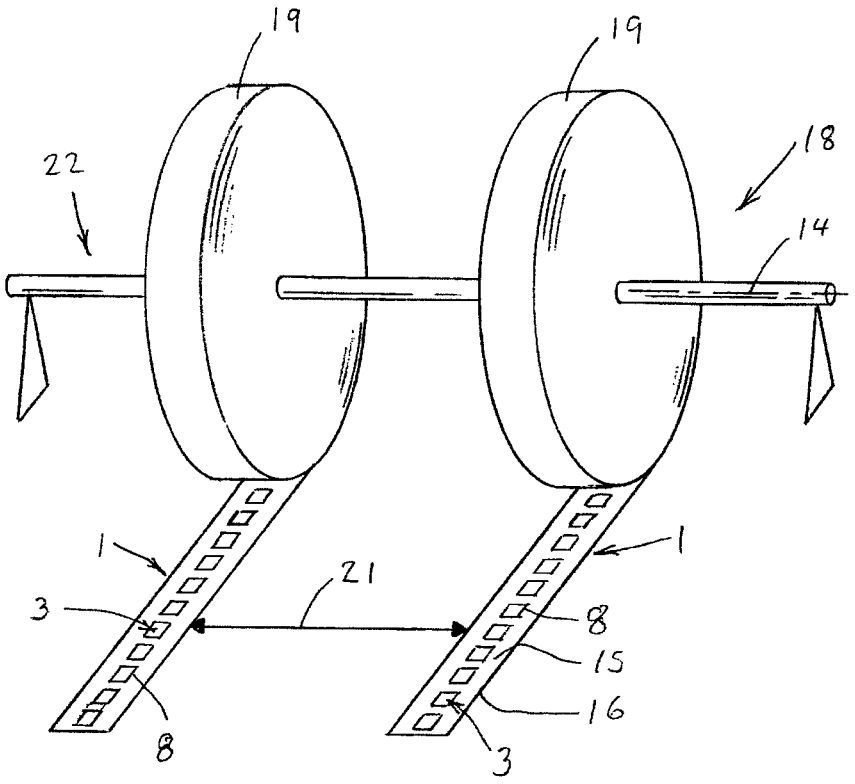
FIG. 2 is a schematic illustration of a coiled masonry reinforcement with two reinforcement stripes on a rack.
Figure 3:
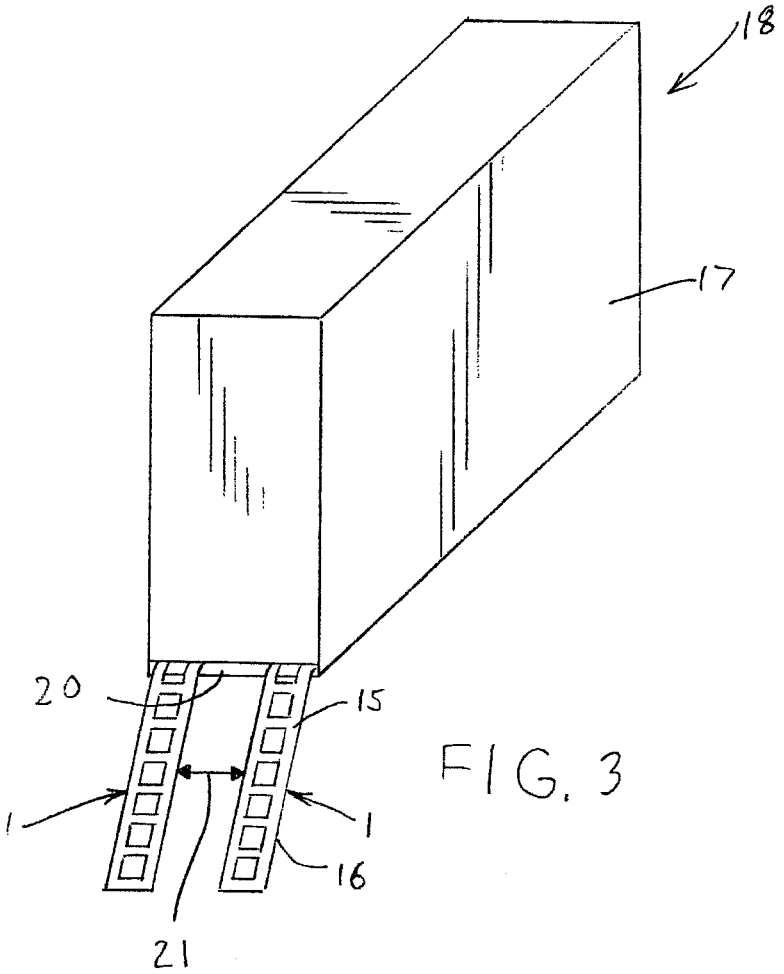
FIG. 3 is a schematic illustration of a dispenser for a masonry reinforcement.

According to the schematic illustration of FIG. 2 a pair of rolls is shown, each of the rolls 19 being arranged on a mutual pivoting or dispenser axis 14 in rack 21. The rolls 19 can be constructed such, that the rim serration members 8 protruding out of the stripe plane 2 are orientated inwardly, that means into the direction of roll axis 14. Surface serration members 9 can be arranged on the inner side of the stripe (top side 15) and/or on the outer side of the stripe (bottom side 16, not shown in FIGS. 2 and 3). Transporting and/or storing of the coil stripe 1 can be done within a package or a housing 17. For simplified unrolling of the stripe 1, dispenser 18 for dispensing reinforcement stripes 1 can be used, the dispenser 18 is schematically shown in FIG. 3. In dispenser 18 according to FIG. 3 at least one dispenser roll is arranged, on that two reinforcement stripes 1 are arranged side by side. Preferably dispenser 18 can comprise two dispenser rolls 19, arranged side by side and coaxial according to an assembly that is schematically shown in FIG. 2. From a dispenser opening 20 of the dispenser 18 according to FIG. 3 two reinforcement stripes 1 (for example shown in FIG. 1) can be dispensed by operating the dispender rolls 19 together. Thus for a masonry 26 with propriate masonry width or masonry size two side by side arranged reinforcement stripes can be dispensed, so that reinforcement is improved and the handling of the reinforcement stripes 1 is simplified.

The distance 21 between dispenser rolls 19 is variable according to FIG. 2, so that also the distance between the reinforcement stripes 1 is variable. Variation of the distance 21 of the dispenser rolls 19 or the reinforcement stripes 1 can be made such, that the reinforcement stripes 1 are arranged side by side fitting to the masonry size. By variation of the distance 21 of dispenser roll 19 the total width of the pair of reinforcement stripes becomes variable and fittable to the masonry size. Variation of distance 21 can for example be done by the user individually. It can also be the case, that a certain dispenser roll distance is chosen and preset by the manufacturer. According to a further embodiment of the dispenser 18 at least one further reinforcement stripe can be provided (not shown in FIGS. 2 and 3).

Additionally it can be provided, that the reinforcement stripes 1 shown in FIGS. 2 and 3 schematically, are interconnected, particularly at multiple connection points. Thus the reinforcement stripes 1 can be dispensed from the dispenser simultaneously and can be unrolled in a parallel way.

Figure 4:
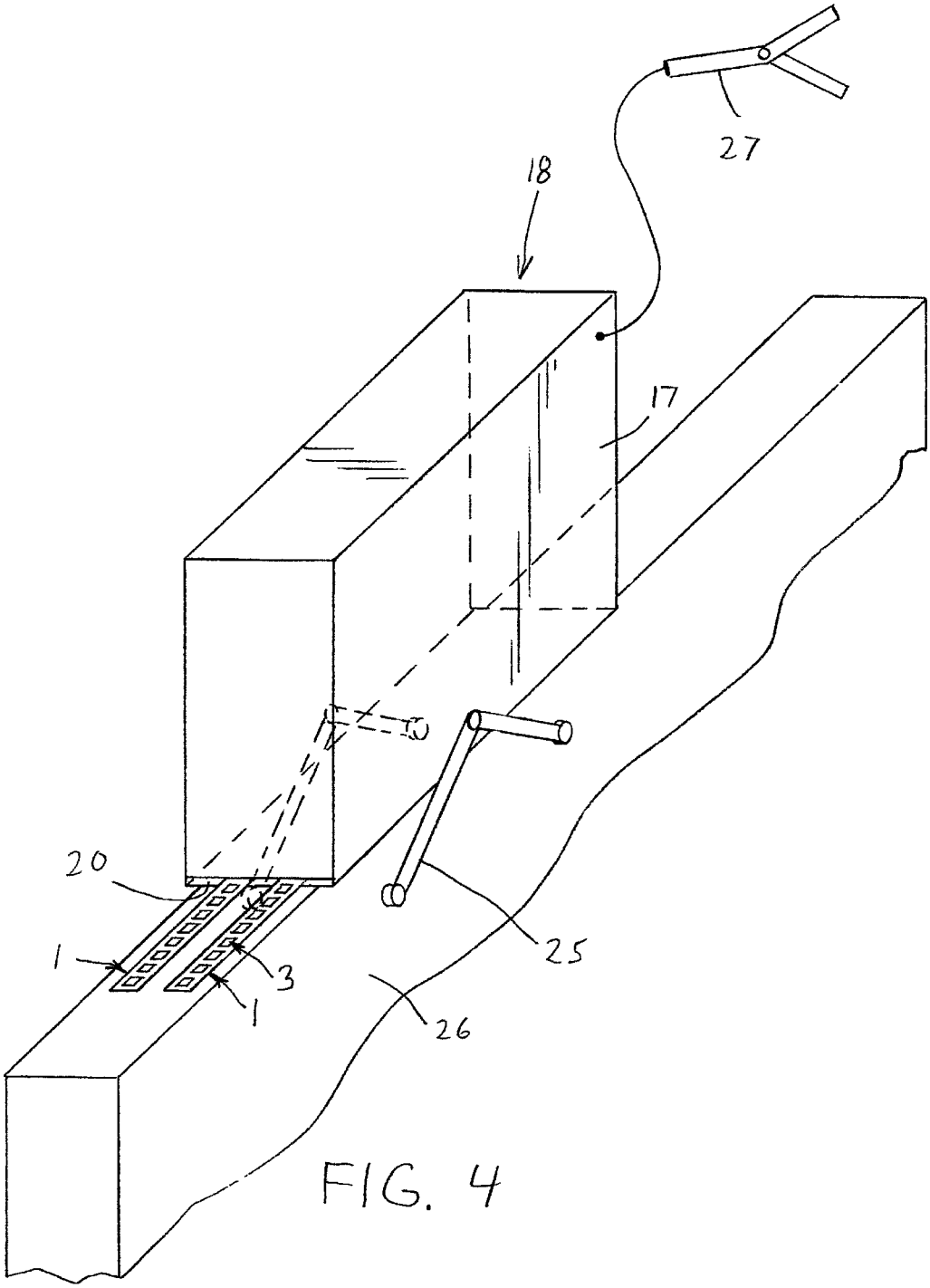
FIG. 4 is a schematic illustration of a version of the dispenser for a masonry reinforcement.

FIG. 4 shows a schematic illustration of a version of dispenser 18. Dispenser 18 comprises fixing and guidance mean 25. With the fixing and guidance means 25 dispenser 18 can be fixed on a masonry 26 and be guided on the edge of the masonry 26. The fixing and guiding means 25 is constructed with two clamps or braces, that are arranged at housing 17 of dispenser 18, in particular arranged pivot able. The braced can be arranged such, that they embrace or clasp the top edge of the masonry 26 that is to be provided with reinforcement elements 1. The braces cause a clamping effect, so that dispenser 18 can be locked on masonry 26. The reinforcement stripe 1 can be dispensed from the dispenser 18 without the user retaining the dispenser 18. According to FIG. 4 dispenser 18 also comprises separation means 27, wherein the reinforcement stripe 1 can be cut with the separation means 27. Separation means 27 is arranged at the housing 17 of the dispenser 18 in captive manner with a fastener. Separation means 27 is used, when the end of masonry 26 is reached and the length of the reinforcement stripe 1 has to be fitted to the length of the masonry 26.

REFERENCE NUMBERS

1 reinforcement stripe
2 stripe plane
3 stripe aperture
4 stripe land
5 stripe edge
6 aperture rim
7 peak
8 rim serration member
9 surface serration member
10 (stripe) surface
11 lettering/labeling
12 roughend portion
13 cam
14 dispenser axis
15 top side
16 bottom side
17 dispenser housing
18 dispenser
19 dispenser roll
20 dispenser opening
21 distance
22 dispenser rack
23 intermediate stripe range
24 row of stripe apertures
25 fixing and/or guidance means
26 masonry
27 separation means

The invention claimed is:

1. Masonry reinforcement comprising a reinforcement strip having a longitudinal axis extending along a length thereof and a transverse axis extending perpendicular to the longitudinal axis along a width thereof, said reinforcement strip being bendable along the longitudinal axis and configured to be rollable into a roll of reinforcement strip and to be subsequently unrolled from said roll of reinforcement strip to lie in a generally flat plane on a masonry surface, said reinforcement strip defining a strip plane and having first and second outer peripheral side edges, said reinforcement strip along a longitudinal strip direction being provided with multiple strip apertures spaced apart from each other, each of said strip apertures comprising an aperture rim having first and second opposing sides each extending across a major portion of the width of the reinforcement strip, and third and fourth opposing sides extending along the length of the reinforcement strip between the first and second sides, characterized in that bendable rim serration members are arranged at said aperture rims of some or of all of said strip apertures, said rim serration members extending partially into said apertures, at least two of said rim serration members extending from the respective third and fourth opposing sides of the aperture rim towards each other; said reinforcement strip includes a plurality of surface serration members, cams or combinations thereof on a top surface of the strip, the top surface of the strip adjacent said first and second outer peripheral side edges and the top surface of the strip in a region about said strip apertures lying in a same flat plane when said reinforcement strip is positioned to lie in the generally flat plane on the masonry surface, said surface serration members, cams or combinations thereof extending above said flat plane, said bendable rim serrations configured to bend such that a portion of said bendable rim serrations is positioned above or below said flat plane.

2. The masonry reinforcement according to claim 1, characterized in that said rim serration members in at least one direction protrude out of said strip plane of said reinforcement strip.

3. The masonry reinforcement according to claim 1, characterized in that said rim serration members are oriented inwardly with respect to each of said strip apertures.

4. The masonry reinforcement according to claim 2, characterized in that said rim serration members are generated by bending or die-cutting of said aperture rims, said strip apertures comprising said rim serration members.

5. The masonry reinforcement according to claim 1, characterized in that said rim serration members comprise an uneven course shape selected from the group consisting of a serrated shape, and a wavy shape.

6. The masonry reinforcement according to claim 1, characterized in that said strip apertures have a shape selected from the group consisting of round shape, oval shape, triangular shape, rectangular shape, and polygonal shape.

7. The masonry reinforcement according to claim 1, characterized in that surface serration members are arranged on the reinforcement strip at a location that is between two strip apertures, between an edge of said reinforcement strip and said strip aperture, or combinations thereof, said surface serration members extending upwardly from a top surface of said reinforcement strip.

8. The masonry reinforcement according to claim 7, characterized in some or all of said surface serration members are generated by roughening said top surface of said strip by stampings.

9. The masonry reinforcement according to claim 7, characterized in that at least some of said surface serration members are generated by cams.

10. The masonry reinforcement according to claim 1, characterized in that said reinforcement strip is made of a material selected from the group consisting of a metal, a metal alloy, a noble metal, and a noble metal alloy.

11. The masonry reinforcement according to claim 1, characterized in that said reinforcement strip is made of a nonmetallic material.

12. Masonry reinforcement comprising a reinforcement strip, said reinforcement strip configured to be rollable into a roll of reinforcement strip and to be subsequently unrolled from said roll of reinforcement strip to lie in a generally flat plane on a masonry surface, said reinforcement strip defining a strip plane and having a top surface extending between first and second outer peripheral side edges and being bendable in at least one direction, said reinforcement strip along the longitudinal strip direction being provided with multiple strip apertures, each of said strip aperture comprising an aperture rim, characterized in that surface serration members, cams or combinations thereof are arranged on said top surface of said reinforcement strip at a location that is between two strip apertures, between a peripheral side edge of said reinforcement strip and said strip aperture, or combinations thereof, said surface serration members, cams or combinations thereof extending upwardly from the top surface of said reinforcement strip, the top surface of said reinforcement strip adjacent said first and second outer peripheral side edges and the top surface in a region about said apertures lying in a same flat plane when said reinforcement strip is positioned to lie in the generally flat plane on the masonry surface, said surface serration members, cams or combinations thereof extending above said flat plane.

13. The masonry reinforcement according to claim 12, characterized in some or all of said surface serration members are generated by roughening said top surface of said strip by stampings.

14. The masonry reinforcement according to claim 12, characterized in that at least some of said surface serration members are generated by cams.

15. The masonry reinforcement according to claim 12, characterized in that said reinforcement strip is made of a material selected from the group consisting of a metal, a metal alloy, a noble metal, and a noble metal alloy.

16. The masonry reinforcement according to claim 12, characterized in that said reinforcement strip is made of a nonmetallic material.

17. A masonry reinforcement comprising a reinforcement strip, said reinforcement strip configured to be rollable into a roll of reinforcement strip and to be subsequently unrolled from said roll of reinforcement strip to lie in a generally flat plane on a masonry surface, a top surface of said reinforcement strip defining a strip plane and being bendable perpendicular to said strip plane, said reinforcement strip including first and second side edges along a longitudinal strip direction, said reinforcement strip includes a plurality of apertures positioned along said longitudinal strip direction, each of said strip apertures are spaced from one another, each of said strip apertures are spaced from said first and second side edges by a strip edge located on each side of said strip apertures, each of said strip apertures includes an inner edge, said inner edge includes a plurality of bendable serrations, said reinforcement strip includes a plurality of surface serration members, cams or combinations thereof on a top surface of said reinforcement strip, the top surface of said reinforcement strip adjacent said first and second outer peripheral side edges and the top surface of a region about said strip apertures lying in a same flat plane when said reinforcement strip is positioned to lie in the generally flat plane on the masonry surface, said optional surface serration members, cams or combinations thereof extending above said flat plane, said bendable serrations configured to bend such that a portion of said bendable serrations is positioned above or below said flat plane.

18. The masonry reinforcement according to claim 17, wherein said serration members on each of said strip apertures lies in a plane non-parallel to said strip plane of said reinforcement strip.

19. The masonry reinforcement according to claim 17, wherein each of said strip apertures, when said bendable serrations are bent at an angle perpendicular to said strip plane, has a shape that is selected from the group consisting of circular, oval, triangular, rectangular, and polygonal.

20. The masonry reinforcement according to claim 18, wherein each of said strip apertures, when said bendable serrations are bent at an angle perpendicular to said strip plane, has a shape that is selected from the group consisting of circular, oval, triangular, rectangular, and polygonal.

21. The masonry reinforcement according to claim 17, wherein each of said strip apertures includes first and second sides positioned along said longitudinal strip direction, each of said first and second sides of said strip aperture includes at least two of said bendable serrations.

22. The masonry reinforcement according to claim 17, wherein each of said strip apertures includes first and second sides positioned along said longitudinal strip direction, each of said first and second sides of said strip aperture includes at least two of said bendable serrations.

23. The masonry reinforcement according to claim 17, wherein at least two of said bendable serrations have the same shape and size.

24. The masonry reinforcement according to claim 22, wherein at least two of said bendable serrations have the same shape and size.

25. The masonry reinforcement according to claim 23, wherein at least two of said bendable serrations have a curved shape or a triangular shape.

26. The masonry reinforcement according to claim 18, wherein the at least two of said bendable serrations have a curved shape or a triangular shape.

27. The masonry reinforcement according to claim 24, wherein at least two of said bendable serrations have a curved shape or a triangular shape.

28. The masonry reinforcement according to claim 18, wherein each of said strip apertures includes first and second sides positioned along said longitudinal strip direction, each of said first and second sides of said strip aperture includes a plurality of said bendable serrations.

29. The masonry reinforcement according to claim 17, wherein a top surface of said reinforcement strip includes a roughened surface.

30. The masonry reinforcement according to claim 27, wherein a top surface of said reinforcement strip includes a roughened surface.

31. The masonry reinforcement according to claim 27, wherein at least two of said plurality of surface serration members, cams or combinations thereof spaced from and positioned between one of said strip apertures and said side edge of said reinforcement strip.

32. The masonry reinforcement according to claim 18, wherein at least two of said plurality of surface serration members, cams or combinations thereof spaced from and positioned between one of said strip apertures and said side edge of said reinforcement strip.

33. The masonry reinforcement according to claim 28, wherein said reinforcement strip includes a plurality of both surface serration members and cams extending upwardly from said top surface of said reinforcement strip, at least two of said plurality of surface serration members and at least two of said plurality of cams spaced from and positioned between one of said strip apertures and said side edge of said reinforcement strip, said cams having a different configuration from said surface serration members.

34. The masonry reinforcement according to claim 30, wherein said reinforcement strip includes a plurality of both surface serration members and cams extending upwardly from said top surface of said reinforcement strip, at least two of said plurality of surface serration members and at least two of said plurality of cams spaced from and positioned between one of said strip apertures and said side edge of said reinforcement strip, said cams having a different configuration from said surface serration members.

35. The masonry reinforcement according to claim 17, wherein said reinforcement strip is made of a material selected from the group consisting of a metal, a metal alloy, a noble metal, a noble metal alloy, and a nonmetallic material.

36. The masonry reinforcement according to claim 34, wherein said reinforcement strip is made of a material selected from the group consisting of a metal, a metal alloy, a noble metal, a noble metal alloy, and a nonmetallic material.

37. The masonry reinforcement according to claim 17, wherein said reinforcement strip is rolled onto a dispenser roll such that said reinforcement strip can be dispensed by a strip dispenser on a masonry surface by unrolling said reinforcement strip from the dispenser roll.

38. The masonry reinforcement according to claim 18, wherein said reinforcement strip is rolled onto a dispenser roll such that said reinforcement strip can be dispensed by a strip dispenser on a masonry surface by unrolling said reinforcement strip from the dispenser roll.

39. The masonry reinforcement according to claim 36, wherein said reinforcement strip is rolled onto a dispenser roll such that said reinforcement strip can be dispensed by a strip dispenser on a masonry surface by unrolling said reinforcement strip from the dispenser roll.

* * * * *